US006648138B1

(12) United States Patent
Kelly

(10) Patent No.: US 6,648,138 B1
(45) Date of Patent: Nov. 18, 2003

(54) GOLF BALL STACKING AND DISPENSING TRAY

(76) Inventor: Gregory J. Kelly, 133 Lakeshore Dr., Duluth, GA (US) 30096

( * ) Notice: Subject to any disclaimer, the term of this patent is extended or adjusted under 35 U.S.C. 154(b) by 8 days.

(21) Appl. No.: 10/022,955

(22) Filed: Dec. 17, 2001

(51) Int. Cl.[7] ..... B65D 85/58
(52) U.S. Cl. ..... 206/315.9; 211/14; 206/564
(58) Field of Search ..... 206/315.9, 562, 206/563, 564; 220/608; 229/406; 211/14

(56) References Cited

U.S. PATENT DOCUMENTS

| | | | | | |
|---|---|---|---|---|---|
| 3,272,371 | A | * | 9/1966 | Weiner | 206/511 |
| 3,589,511 | A | * | 6/1971 | Britt | 206/518 |
| 3,740,238 | A | * | 6/1973 | Graham | 426/124 |
| 3,896,239 | A | * | 7/1975 | Peters | 426/119 |
| 4,009,817 | A | * | 3/1977 | Marshall et al. | 229/406 |
| D336,406 | S | * | 6/1993 | Wytiuk | D7/504 |
| 5,266,369 | A | * | 11/1993 | Ando et al. | 428/35.7 |
| 5,746,332 | A | * | 5/1998 | Kleinschmidt | 211/153 |
| 5,882,173 | A | * | 3/1999 | Ziegler | 414/788 |

* cited by examiner

*Primary Examiner*—David T. Fidei
(74) *Attorney, Agent, or Firm*—Gibbons, Del Deo, Dolan, Griffinger & Vecchione

(57) ABSTRACT

A tray for stacking and dispensing golf balls, comprising (a) a base frame having a substantially rectangular central region bounded by a peripheral region, (b) a plurality of rails in the central region, and (c) a plurality of resting surfaces also in the central region. The peripheral region including two pairs of opposing and elongated sides forming a substantially rectangular boundary of the central region and that are perpendicular to each other. The rails and resting surfaces are arranged relative to each other such that neighboring rails are separated from each other by a resting surface and neighboring resting surfaces are separated from each other by a rail. Each of the rails has a convex curvature as viewed from the top side of the tray. In addition, each of the rails has an associated apex, the apexes of the plurality of the rails being in a common tangential plane with each other. Each of the resting surfaces lies outside the common tangential plane, and appears recessed with respect to the rails when the tray is viewed from the top side. The two pairs of opposing and elongated sides of the peripheral region have a concave curvature when the tray is viewed from the top side. The rails and the resting surfaces are arranged in parallel with one pair of opposing and elongated sides of the peripheral region. Each of these sides is adjacent to a resting surface.

13 Claims, 2 Drawing Sheets

GOLF BALL STACKING AND DISPENSING TRAY

CROSS-REFERENCE TO RELATED PATENT APPLICATIONS

"Golf Ball Stacking and Dispensing Apparatus and Method," filed concurrently.

BACKGROUND OF THE INVENTION

1. Field of the Invention

The present invention relates to a tray for stacking and dispensing golf balls, and more particularly pertains to a tray for stacking golf balls in a pyramidal fashion and dispensing golf balls from the stack for use.

2. Discussion of the Related Art

It is generally desirable at golf practice areas, such as driving ranges, to provide golfers with large supplies of golf balls for use during a practice session. Conventionally, a supply of balls is provided via a basket, with the balls either removed by hand by the golfer, or the basket tipped over and the supply of balls scattered. In the former case, the golfer wastes significant time and energy in repeatedly bending over to retrieve individual balls from the basket. In the latter case, the balls are likely to scatter around the practice area, creating a cluttered practice area as well as a tripping hazard for the golfer. Additionally in the latter case, some balls are likely to roll beyond the practice area, thus requiring time-and-energy consuming retrieval by the golfer or golf facility personnel.

The prior art discloses means for providing a supply of golf balls for a practice session, where the balls are stacked in a pyramidal fashion. Square pyramidal stacks of golf balls are provided by the methods and apparatus disclosed in U.S. Pat. No. 5,381,895 to Thomsen; U.S. Pat. No. 5,467,574 to Thomsen; U.S. Pat. No. 5,552,832 to Kelly; and U.S. Pat. No. 5,882,173 to Ziegler. Such pyramidal stacking systems, all involving a tray onto which the balls are stacked, offer advantages over baskets in terms of ease of dispensing balls for use. One or more of the stacked balls may be knocked from the stack by the golfer using the head of his or her club, without the need for the golfer to repeatedly bend over to retrieve individual balls. Pyramidal stacking further avoids the balls cluttering the practice area or creating a tripping or other hazard, as is the case with a tipped basket. Pyramidal stacking offers the still further advantage of an aesthetically pleasing manner of presenting a supply of golf balls for use.

The prior pyramidal stacking apparatus and methods, however, present other limitations. The Thomsen patents disclose a tray for stacking golf balls where the tray includes a square array of spherical depressions for receiving the golf balls. A pyramidal hopper is placed over the tray and golf balls are poured into a top opening of the hopper. As balls fill the spherical depressions, the base layer of the pyramidal display is formed. As more balls are poured into the hopper, subsequent layers are formed until the pyramidal stack is complete. Larger stacks of balls may be produced in this manner. Indeed, the Thomsen patents disclose pyramidal stacks of up to 204 balls (8 layers, 8×8 balls on the bottom layer). However, Thomson's disclosure of individual spherical depressions for the bottom layer of balls in the array makes filling that layer without significant user manipulation problematic. The spherical depressions also make dispensing of the balls from the bottom layer with simply the head of a golf club, difficult. Further, since the spherical depressions are impacted by golf balls being dropped on them each time a pyramidal stack is to be formed, the tray must be made of sufficiently durable material to withstand the impact if the tray is to have any appreciable life.

The Ziegler patent discloses a golf ball tray having a plurality of substantially parallel rails within a rectangular frame. The rails are substantially uniformly spaced apart, with the spacing such that a golf ball may not pass between adjacent rails, but instead is constrained to lie on each of two adjacent rails and roll along their lengths in a groove formed therebetween. The spacing between the center lines of adjacent rails is larger than the diameter of a golf ball and less than 1.414 times that diameter. Balls are stacked on the tray by placing a pyramidal hopper on the tray, pouring balls into the hopper until a base layer is filled and a pyramidal stack is formed, and subsequently removing the hopper. Balls may be dispensed from the stack by rolling from the stack or along the grooves and over the side of the tray frame. In an alternative embodiment, Ziegler discloses that the top edge of the tray may be beveled to slope down inwardly toward the rails. According to Ziegler, beveling the top edge of the ball tray may facilitate dispensing golf balls over the edge of the tray. According to Ziegler, this beveling/shaping may enhance the constraint of golf balls to roll along the grooves between adjacent rails.

Ziegler discloses pyramidal stacks of 285 and 385 golf balls, which Ziegler claims will be sufficient for a two hour practice session at a "typical" rate of three balls used per minute. However, Ziegler's ball tray, even with beveled edges on the rails, includes exposed angled edges subject to deterioration from repeated forceful contact with golf balls being poured through the hopper. That is, after a period of repeated use, the forced contact of the golf balls with the edges of the rails will cause those edges to become deformed and misshapen, affecting the ability of the rails to form the requisite bottom layer of balls to support the pyramidal stack. Alternatively, where the rails are made of relatively impervious material (i.e., metal or concrete, both disclosed in Ziegler), the forced contact of the golf balls with the rigid, impervious angled edges will eventually result in damaged balls, useless to the golfer. Still further, the ball tray of Ziegler, with rails of concrete and holding a pyramidal stack of 285 or 385 balls, clearly is not portable by the average golfer or golf facility employee. That is, a golfer wishing merely to purchase and hit "a bucket of balls," (that is, approximately 100 balls), will be physically unable to do so using the ball tray disclosed in Ziegler. Further such large stacks of balls, 9 or 10 balls high, not including the height of the tray, are awkward for the average golfer to use. Still further, the ball tray of Ziegler, when fixed into the ground at the driving range site, is exposed to the weather, thus increasing the speed of deterioration of the tray.

What is needed is a tray for stacking and dispensing golf balls, which allows the balls to be stacked for ease in dispensing by a golfer, and provides for ease of dispensing of all stacked balls, and is portable by the average golfer or golf facility employee. What is further needed is a tray for stacking and dispensing golf balls that will not deteriorate or become damaged as the result of repeated forceful contact with golf balls. What is further needed is a tray for stacking and dispensing golf balls that will not damage or deteriorate the golf balls as the result of repeated forceful contact with the tray.

Accordingly, the present invention provides a tray for stacking and dispensing golf balls, which allows the balls to be stacked for ease in dispensing by a golfer, provides for ease of dispensing of all stacked balls, and is portable by the average golfer. The present invention also provides a tray for stacking and dispensing golf balls that will not deteriorate or become damaged as the result of repeated forceful contact with golf balls. The present invention further provides a tray for stacking and dispensing golf balls that will not damage or deteriorate the golf balls as the result of repeated forceful contact with the tray.

BRIEF SUMMARY OF THE INVENTION

The golf ball stacking and dispensing tray of the present invention comprises a substantially rectangular central region bounded by a peripheral region, the peripheral region including two pairs of opposing and elongated sides forming a substantially rectangular boundary of the central region and that are perpendicular to each other, the central region including a plurality of rails and a plurality of resting surfaces, the tray having a top side and a bottom side.

The rails and resting surfaces are arranged relative to each other such that neighboring rails are separated from each other by a resting surface and neighboring resting surfaces are separated from each other by a rail. Each of the rails has a convex curvature as viewed from the top side of the tray. In addition, each of the rails has an associated apex, the apexes of the plurality of the rails being in a common tangential plane with each other.

Each of the resting surfaces is arranged and configured to lie outside the common tangential plane, and appears recessed with respect to the rails when the tray is viewed from the top side. The two pairs of opposing and elongated sides of the peripheral region have a concave curvature when the tray is viewed from the top side. The rails and the resting surfaces are arranged in parallel with one pair of opposing and elongated sides of the peripheral region. Each of these sides is adjacent to a resting surface.

DETAILED DESCRIPTION OF THE INVENTION

Figure 1:
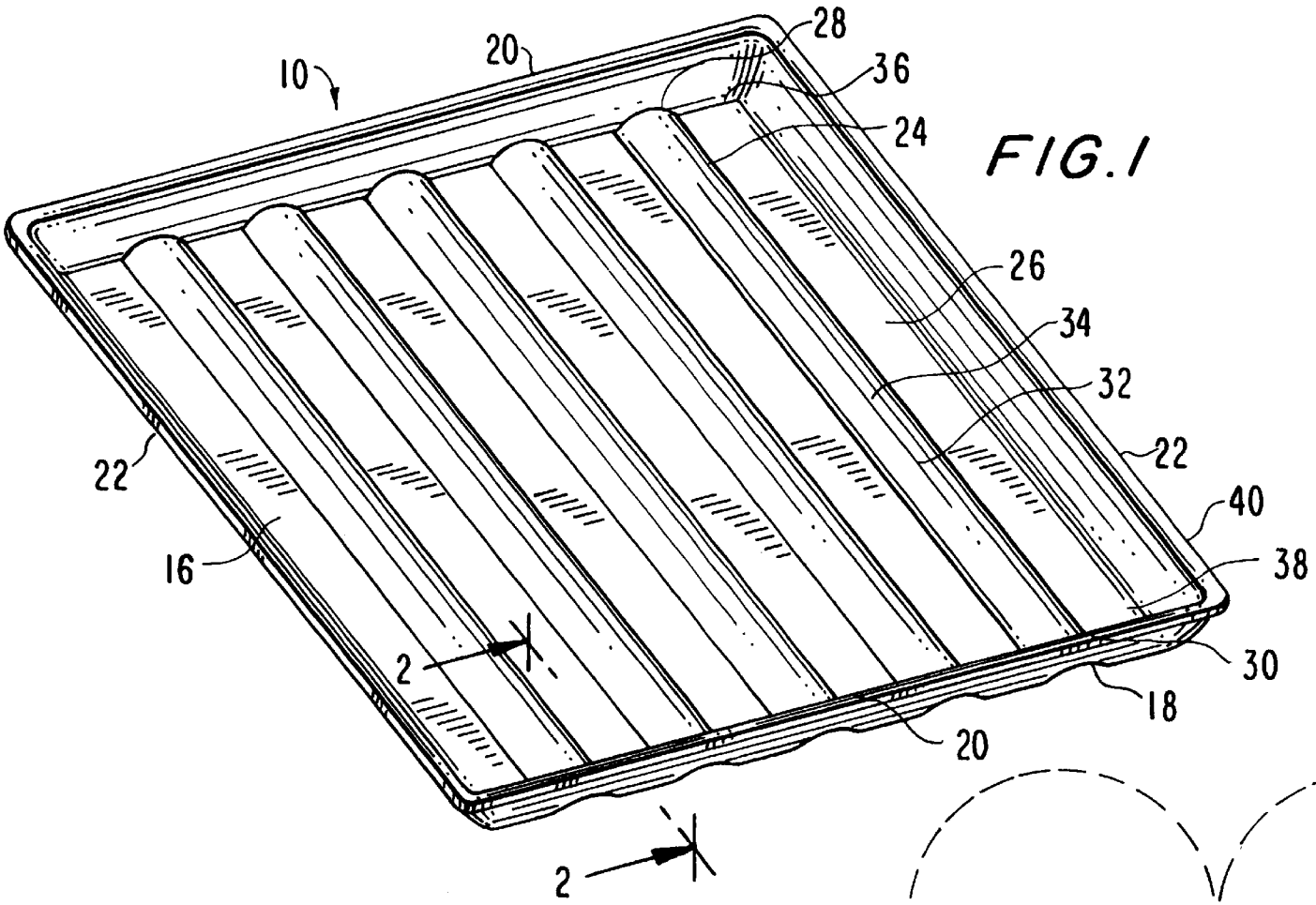
FIG. 1 shows a top perspective view of the golf ball stacking and dispensing tray of the present invention.
Figure 2:
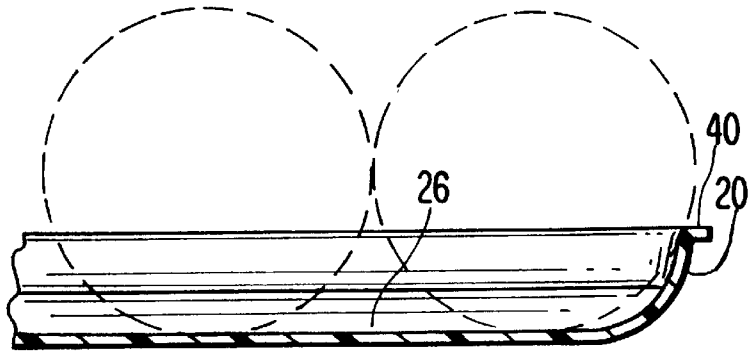
FIG. 2 shows a cross-section across 2—2 of FIG. 1.

Turning to FIGS. 1–4, the golf ball stacking and dispensing tray 10 of the present invention comprises a substantially rectangular central region and a peripheral region that bounds the central region. The tray 10 has a top side 16 and a bottom side 18. The peripheral region includes two pairs of opposing and elongated sides 20, 22 that form the boundary of the central region and that are concavely-curved and perpendicular with each other. Together, the two pairs of opposing sides describe a substantially rectangular frame shape with an inner perimeter identical to that of the outer perimeter of the central region. The central region includes a plurality of rails 24 and a plurality of resting surfaces 26.

Each of the rails 24 has two ends 28, 30. The upper surface 32 of each of the rails 24 has a respective apex 34 within a common tangential plane. Each of the resting surfaces 26 is flat and has two ends 36, 38, and a width bounded between neighboring ones of the rails 24. Each of the resting surfaces 26 is configured and arranged to lie outside the common tangential plane. In a preferred embodiment, the tray 10 is at least one-half inch deep and no more than one inch deep.

The ends 28, 30 of each of the rails 24 are integral with or attached to a transversely extending pair of opposing sides 20. Each of the plurality of rails 24 is substantially parallel to the other pair of opposing sides 22. Neighboring ones of the rails 24 are uniformly spaced apart from each other in succession.

Each of the resting surfaces 26 is substantially parallel to each of the sides of the other pair of opposing sides 22, and also is substantially parallel to each of the rails 24. The ends 36, 38 of each of the resting surfaces 26 are attached to the same opposing one pair of transversely extending opposing sides 20, as are attached the ends 28, 30 of each of the rails 24. The resting surfaces 26 are uniformly spaced apart from each other in succession.

The rails 24 and the resting surfaces 26 are arranged relative to each other such that neighboring of the rails 24 are separated by adjacent ones of the resting surfaces 26, and neighboring of the resting surfaces 26 are separated by adjacent ones of the rails 24.

The width of each resting surface 26 is sufficient to permit a golf ball to rest on the surface 26 situated between neighboring rails 24 without contacting either of those rails 24. In addition, the upper surfaces 32 of each of the rails 24 is convexly curved, thereby preventing the dropped balls from resting thereon and thus assuring that the dropped balls will rest on the resting surfaces 26 between neighboring rails 24.

Each of the opposing sides 22 that is parallel to each of the plurality of rails 24 and is also parallel to each of the resting surfaces 26, is adjacent to neighboring ones of the resting surfaces 26. In this manner, the stacking tray 10 of the present invention is able to accommodate a maximum number of rows of balls (and thus a maximum number of pyramidally stacked balls) in a limited space, and with a limited weight. The other pair of transversely extending opposing sides 20 facilitates dispensing the balls from the lowest layer of the pyramidal stack.

The diameter of the rails 24 combined with the width of the resting surfaces 26 allows balls in the base layer, resting on the resting surfaces 26, to be moved easily along an axis parallel to the axis of the rails 24. That is, movement of the balls in the base layer is constrained only by the force of the balls in the succeeding layers. This facilitates the complete filling of the base layer of the pyramidal golf ball stack with little or no manipulation by the golfer or golf facility employee.

In a preferred embodiment, the substantially rectangular central region is substantially square. Preferably, each pair of opposing sides 20, 22 is no more than 14 inches apart. The plurality of rails 24 is thus no more than seven in number, and the plurality of resting surfaces 26 is no more than eight in number. As such, the base layer of balls is no more than eight balls by eight balls, or sixty-four in number.

As described, the golf ball stacking tray of the present invention is able to support a regular pyramidal stack of balls of up to 204 in number. At a rate of three balls per minute, a full stack of balls using the stacking tray of the present invention thus will support a practice session of approximately 70 minutes. Additionally, the maximum pyramidal stack of balls supported by the tray of the present invention—eight balls in height—is sufficiently short so that an average golfer can dispense balls therefrom without discomfort or other unease.

The stacking tray of the present invention may be made of any durable, lightweight substance, such as plastic or polymers, and may be formed by a conventional plastic molding technique. The use of concave curvature on opposing sides 20, 22 of the peripheral region combined with the convex curvature displayed by the upper surface 32 of the rails 24, further promotes the durability of the stacking tray 10, as well as of the golf balls stacked thereon. Repeated dropping of golf balls onto the stacking tray 10 of the present invention (to form the base layer of balls for the pyramidal stack) will not result in damage either to the tray 10 itself, or to the balls.

By contrast, repeated dropping of golf balls onto a stacking tray having sharply angled interior edges, whether rectilinear or beveled or otherwise shaped, eventually will result in damage either to the edges, or to the balls. Repeated dropping of golf balls through the hopper and onto the rails of a tray with beveled edges or corners eventually would be expected to result in damage to the edges or corners of those rails, if the rails are not strong enough to withstand repeated impact of the balls on them. As a consequence, the rails will become pitted and otherwise misshapen, and the base layer of golf balls will not be sufficiently organized to support a pyramidal stack. Indeed, once the edges are sufficiently pitted, damaged or otherwise misshapen, a pyramidal stack will no longer be able to be supported by the stacking tray, once the hopper is removed.

In addition to damage to and eventual ruin of the sharply angled stacking tray for its intended purpose, repeated dropping of golf balls onto the sharply angled edges of the rails eventually will result in damage to the balls, themselves. That is especially true where the edged rails are made from sufficiently durable, impervious material, such as concrete, to withstand repeated impact by dropped balls. In such case, the balls themselves, whose covers have been shown by common experience to be subject to damage by contact with the edge of a golf club, will be damaged and eventually rendered useless by repeated dropping onto the rigid, sharply angled edges of the rails.

As the stacking tray must be able to be used repeatedly to be cost-effective, damage to the tray itself and/or to the balls stacked thereon severely compromises the useful life of any stacking tray having sharply angled edges. However, as noted, the use of rails 24 and opposing sides 20, 22 of the peripheral region prevents the dropped golf balls from contacting any sharply angled edge as they contact the tray 10 due to their convex/concave curvature, whether at the upper surface 32 of one of the rails 24 or at one of the resting surfaces 26. Thus, damage to both the balls and the tray 10 is avoided, and the tray 10 may be used effectively, repeatedly, for an extended period of time, thereby reducing replacement costs to the golfer or golf course.

Figure 3:
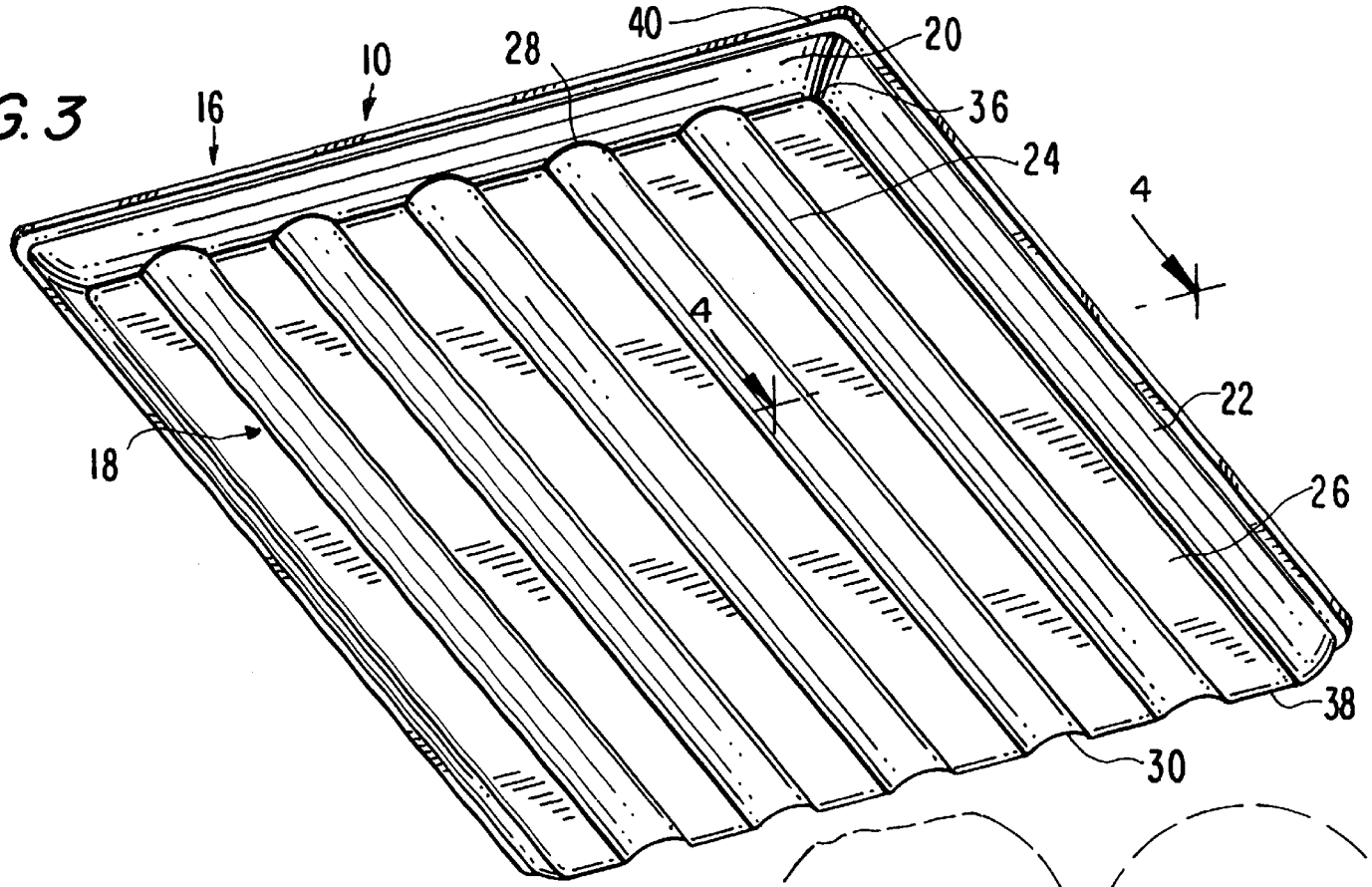
FIG. 3 shows a bottom perspective view of the golf ball stacking and dispensing tray of the present invention.
Figure 4:
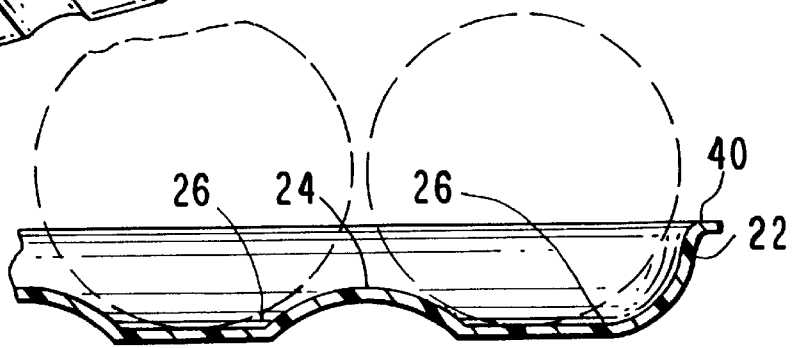
FIG. 4 shows a cross-section across 4—4 of FIG. 3.

Comparing FIG. 1 and FIG. 3, while the tray 10, when viewed from the top side 16, appears to have opposing sides 20, 22 in the peripheral region that are concavely curved and rails 24 in the central region that are convexly curved, the view from the bottom side 18 is of the opposing sides 20, 22 being convexly curved and the rails being concavely curved. Additionally, when the tray 10 is viewed from the top side 16, the resting surfaces 26 appear recessed with respect to the rails 24.

If desired, a lip 40 may be provided that extends outwardly from each opposed side 20, 22.

While the invention has been described with respect to certain specific embodiments, it will be appreciated that many modifications and changes may be made by those skilled in the art without departing from the invention. It is intended, therefore, by the appended claims to cover all such modifications and changes as may fall within the true spirit and scope of the invention.

What is claimed is:

1. A golf ball stacking and dispensing tray, comprising:

a substantially rectangular central region bounded by a peripheral region, the peripheral region including two pairs of opposing and elongated sides forming a substantially rectangular boundary of the central region and that are perpendicular to each other, the central region including a plurality of rails and a plurality of resting surfaces, the tray having a top side and a bottom side; wherein:

the rails and resting surfaces are arranged relative to each other such that neighboring ones of the rails are separated from each other by adjacent ones of the resting surfaces and neighboring ones of the resting surfaces are separated from each other by adjacent ones of the rails;

each of the rails is configured to have a convex curvature as viewed from the top side of the tray;

each of the rails has an associated apex, the apexes of the plurality of the rails being in a common tangential plane with each other;

each of the resting surfaces is arranged and configured to lie outside the common tangential plane, so as to appear recessed with respect to the rails when the tray is viewed from the top side, each of the plurality of resting surfaces being flat;

the two pairs of opposing and elongated sides of the peripheral region have a concave curvature when the tray is viewed from the top side;

the plurality of rails and the plurality of resting surfaces are arranged in parallel with one pair of the two pairs of opposing and elongated sides of the peripheral region; and the opposing and elongated sides of the one pair are adjacent to neighboring ones of the plurality of resting surfaces.

2. The tray of claim 1, wherein the rails are integrally formed with and thus in connection wlth the other pair of the two pairs of opposing sides of the peripheral region.

3. The tray of claim 1, wherein the resting surfaces are integrally formed with and thus in connection with the other pair of the two pairs of opposing sides of the peripheral region.

4. The tray of claim 1, wherein the substantially rectangular central region is substantially square.

5. The tray of claim 4, wherein the plurality of rails is no more than seven in number, and the plurality of resting surfaces is no more than eight in number.

6. The tray of claim 1, wherein the peripheral region includes a lip that extends outwardly from the concavely-curved sides.

7. The tray of claim 1, wherein each of the resting surfaces has a width bounded between neighboring ones of the rails that is sufficient to permit a golf ball to rest on the resting surface situated between the neighboring ones of the rails without contacting said rails.

8. A golf ball stacking and dispensing tray, comprising:

a substantially rectangular central region bounded by a peripheral region, the peripheral region including two pairs of opposing and elongated sides forming a substantially rectangular boundary of the central region and that are perpendicular to each other, the central region including a plurality of rails and a plurality of resting surfaces, the tray having a top side and a bottom side; wherein:

the rails and resting surfaces are arranged relative to each other such that neighboring ones of the rails are separated from each other by adjacent ones of the resting surfaces and neighboring ones of the resting surfaces are separated from each other by adjacent ones of the rails;

each of the rails is configured to have a convex curvature as viewed from the top side of the tray;

each of the rails has an associated apex, the apexes of the plurality of the rails being in a common tangential plane with each other;

each of the resting surfaces is arranged and configured to lie outside the common tangential plane so as to appear recessed with respect to the rails when the tray is viewed from the top side;

the two pairs of opposing and elongated sides of the peripheral region have a concave curvature when the tray is viewed from the top side;

the plurality of rails and the plurality of resting surfaces are arranged in parallel with one pair of the two pairs of opposing and elongated sides of the peripheral region;

the opposing and elongated sides of the one pair are adjacent to neighboring ones of the plurality of resting surfaces, and each of the resting surfaces having a width bounded between neighboring ones of the rails that is sufficient to permit a golf ball to rest on the resting surface situated between the neighboring ones of the rails without contacting said rails.

9. The tray of claim 8, wherein the rails are integrally formed with and thus in connection with the other pair of the two pairs of opposing sides of the peripheral region.

10. The tray of claim 8, wherein the resting surfaces are integrally formed with and thus in connection with the other pair of the two pairs of opposing sides of the peripheral region.

11. The tray of claim 8, wherein the substantially rectangular central region is substantially square.

12. The tray of claim 11, wherein the plurality of rails is no more than seven in number, and the plurality of resting surfaces is no more than eight in number.

13. The tray of claim 8, wherein the peripheral region includes a lip that extends outwardly from the concavely-curved sides.

* * * * *